US008603720B2

(12) United States Patent
Zhou et al.

(10) Patent No.: US 8,603,720 B2
(45) Date of Patent: Dec. 10, 2013

(54) TONER COMPOSITIONS AND PROCESSES

(75) Inventors: Ke Zhou, Mississauga (CA); Guerino G. Sacripante, Oakville (CA); Edward G. Zwartz, Mississauga (CA); Michael S. Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 776 days.

(21) Appl. No.: 12/711,681

(22) Filed: Feb. 24, 2010

(65) Prior Publication Data

US 2011/0207046 A1 Aug. 25, 2011

(51) Int. Cl.
*G03G 9/08* (2006.01)

(52) U.S. Cl.
USPC ..... 430/137.14; 430/109.4

(58) Field of Classification Search
USPC ..... 430/137.14, 109.4
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,004,664 | A | 4/1991 | Fuller et al. |
| 5,212,526 | A | 5/1993 | Domoto et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |

(Continued)

FOREIGN PATENT DOCUMENTS

| | | |
|---|---|---|
| EP | 2 071 405 A1 | 6/2009 |
| EP | 2 180 374 A1 | 4/2010 |

(Continued)

OTHER PUBLICATIONS

"A Green Solution for a Black and White World: Bio-based Toner Resin Offers Environmentally Friendly Alternative for Printers and Copiers" Ohio Soybean Review, p. 13, (Sep. 2009).*
Jun. 24, 2011 Search Report issued in GB1103175.4.
Lenz et al., "Bacterial Polyesters: Biosynthesis, Biodegradable Plastics and Biotechnology," Biomacromolecules, vol. 6, No. 1, pp. 1-8 (2005).
Wu, Corrinna, "Weight Control for bacterial plastics," Sci. News, p. 23, vol. 151:2 (1997).

(Continued)

*Primary Examiner* — Christopher Rodee
(74) *Attorney, Agent, or Firm* — Oliff & Berridge, PLC

(57) ABSTRACT

A process for preparing a toner includes forming an emulsion with a buffer solution and an amorphous biodegradable polyester resin represented by Formula (1):

(1)

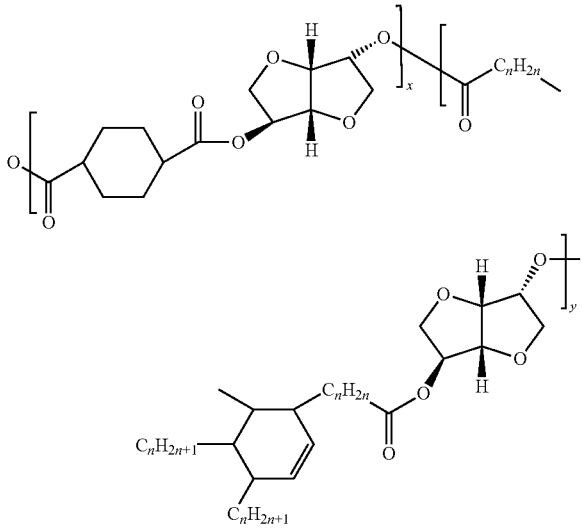

wherein each n independently represents an integer of 1 to about 20 and x and y represent respective ratios of respective monomeric units and x ranges from about 0 to about 1000 and y ranges from about 0 to about 300; adding a colorant, a coagulant, and optionally a wax to the emulsion to form a mixture; heating the mixture, permitting aggregation and coalescence of the mixture to form toner particles; and recovering the toner particles.

19 Claims, No Drawings

(56) References Cited

U.S. PATENT DOCUMENTS

| | | | | |
|---|---|---|---|---|
| 5,853,943 | A | 12/1998 | Cheng et al. | |
| 5,853,944 | A | 12/1998 | Foucher et al. | |
| 5,863,698 | A | 1/1999 | Patel et al. | |
| 5,869,215 | A | 2/1999 | Ong et al. | |
| 5,902,710 | A | 5/1999 | Ong et al. | |
| 5,910,387 | A | 6/1999 | Mychajlowskij et al. | |
| 5,916,725 | A | 6/1999 | Patel et al. | |
| 5,919,595 | A | 7/1999 | Mychajlowskij et al. | |
| 5,925,488 | A | 7/1999 | Patel et al. | |
| 5,977,210 | A | 11/1999 | Patel et al. | |
| 5,994,020 | A | 11/1999 | Patel et al. | |
| 6,120,967 | A | 9/2000 | Hopper et al. | |
| 6,214,507 | B1 | 4/2001 | Sokol et al. | |
| 8,187,780 | B2 * | 5/2012 | McAneney-Lannen et al. | 430/109.4 |
| 2008/0090163 | A1 | 4/2008 | Agur et al. | |
| 2008/0107989 | A1 | 5/2008 | Sacripante et al. | |
| 2008/0145775 | A1 * | 6/2008 | Vijayendran et al. | 430/109.4 |
| 2008/0153027 | A1 | 6/2008 | Veregin et al. | |
| 2008/0176164 | A1 * | 7/2008 | Nair et al. | 430/137.14 |
| 2009/0061342 | A1 * | 3/2009 | Lai et al. | 430/137.14 |
| 2009/0155703 | A1 | 6/2009 | Sacripante et al. | |
| 2010/0159387 | A1 * | 6/2010 | Nosella et al. | 430/137.14 |
| 2011/0097664 | A1 * | 4/2011 | Nosella et al. | 430/137.14 |
| 2011/0195233 | A1 * | 8/2011 | Vijayendran et al. | 430/109.4 |

FOREIGN PATENT DOCUMENTS

| | | |
|---|---|---|
| JP | A-5-74492 | 3/1993 |
| JP | A-5-93049 | 4/1993 |
| JP | B2-6-15604 | 1/1994 |
| JP | A-7-14352 | 1/1995 |
| JP | A-7-265065 | 10/1995 |
| JP | B2-8-19227 | 1/1996 |
| JP | A-9-191893 | 7/1997 |
| WO | WO 2006102280 A1 * | 9/2006 |

OTHER PUBLICATIONS

U.S. Appl. No. 12/255,405 filed in the name of Mcaneney-Lannen et al., filed Oct. 21, 2008, entitled "Toner Composition and Process".

U.S. Appl. No. 12/366,940 filed in the name of Zhou et al., filed Feb. 6, 2009, entitled "Toner Composition and Processes".

* cited by examiner

TONER COMPOSITIONS AND PROCESSES

CROSS REFERENCE TO RELATED APPLICATIONS

The present application relates to co-pending U.S. patent application No. 12/255,405 filed Oct 21, 2008, entitled Toner Composition and Process (now U.S. Pat. No. 8,187,780), the disclosure of which is hereby incorporated by reference in its entirety.

TECHNICAL FIELD

This disclosure is generally directed to toner preparation processes, such as emulsion aggregation processes, and toner compositions formed by such processes. More specifically, this disclosure is generally directed to emulsion aggregation processes utilizing a biodegradable polyester resin, and toner compositions containing such a biodegradable polyester resin.

BACKGROUND

Numerous processes are within the purview of those skilled in the art for the preparation of toners. Emulsion aggregation (EA) is one such method. Emulsion aggregation toners may be used in forming print and/or xerographic images. Emulsion aggregation techniques may involve the formation of an emulsion latex of the resin particles, by heating the resin, using an emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,763,133, 5,766,818, 5,747,215, 5,804,349, 5,827,633, 5,840,462, 5,853,944, 5,869,215, 5,863,698; 5,902,710; 5,910,387; 5,916,725; 5,919,595; 5,925,488, 5,977,210, and 5,994,020, and U.S. Patent Application Publication No. 2008/01017989, the disclosures of which are hereby incorporated by reference in their entirety.

Polyester EA ultra low melt (ULM) toners have been prepared utilizing amorphous and crystalline polyester resins as illustrated, for example, in U.S. Patent Application Publication No. 2008/0153027, the disclosure of which is hereby incorporated by reference in its entirety.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. No. 5,916,725 and U.S. Patent Application Publication Nos. 2008/0090163 and 2008/0107989, the disclosures of which are hereby incorporated by reference in their entirety. Another example, as disclosed in co-pending U.S. patent application Ser. No. 11/956,878 (now U.S. Pat. No. 8,137,884), includes a toner having particles of a bio-based resin, such as, for example, a semi-crystalline biodegradable polyester resin including polyhydroxyalkanoates, wherein the toner is prepared by an emulsion aggregation process.

The vast majority of polymeric materials, including polymeric materials conventionally used for preparing toner compositions, are based upon the extraction and processing of fossil fuels. However, these processes lead ultimately to increases in greenhouse gases and accumulation of non-degradable materials in the environment. Furthermore, some current polyester based toners are derived from bisphenol A, which is a known carcinogen/endocrine disruptor. It is highly likely that greater public restrictions on the use of this chemical will be enacted in the future.

SUMMARY

Accordingly, a need exists for alternative, cost-effective, and environmentally friendly, polyester materials that can be formulated into toner compositions. However, any such alternative materials must still meet the rigorous requirements for high quality imaging systems. These and other needs are achieved in the present disclosure.

Emulsion aggregation processes are also described. In embodiments, a process for preparing a toner comprises: mixing an amorphous biodegradable polyester resin emulsion and a buffer, such as a TRIS-HCl buffer, to form an emulsion; adding a colorant and a coagulant to the emulsion to form a mixture; heating the mixture, permitting aggregation and coalescence of the mixture to form toner particles; and recovering the toner particles.

EMBODIMENTS

Although an amorphous biodegradable polymeric resin is available for various uses, it was found that the amorphous biodegradable polymeric resin could not be readily emulsified into a stable emulsion to permit its use in emulsion aggregation processes for forming toner particles. Furthermore, it was found to be difficult to control particle size and the particle size distribution when the amorphous biodegradable polymeric was used to form ultra low melt toners. In view of these difficulties, it was found that a buffer solution, such as a TRIS-HCl buffer, could be used to emulsify the amorphous biodegradable polymeric resin to allow its use in emulsion aggregation processes for forming toner particles.

It has been found that an amorphous biodegradable polymeric resin could be emulsified and a toner could be prepared successfully, because pH of resin, solvent, and water solution is kept stable, and possible hydrolysis of the amorphous biodegradable polymeric resin is avoided. Also, the amorphous biodegradable polymeric resin may be directly used to prepare toners without the need to use organic solvents, thus providing a more environmentally friendly process. Petroleum-based toner can be replaced with bio-based toner and provide the printer and copier industry with a high performance and environmentally friendly bio-derived toner with excellent image quality.

Amorphous Biodegradable Polymeric Resin

An amorphous biodegradable polyester resin is utilized to form the resin for the toner compositions of the present disclosure.

In embodiments, the amorphous biodegradable polyester resin may be represented by the Formula (1):

(1)

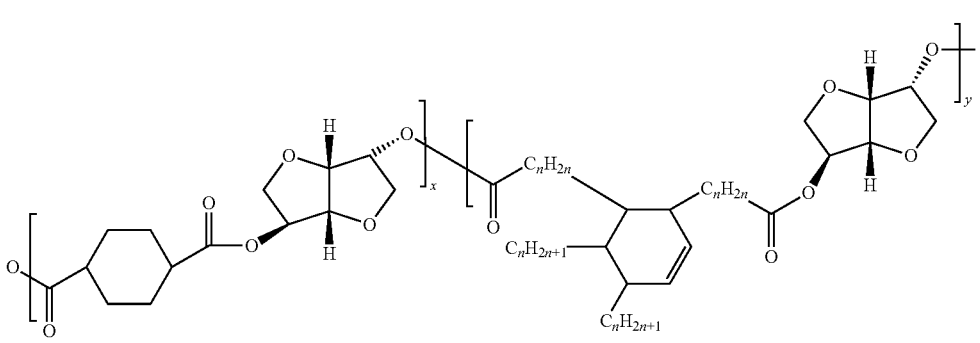

In formula (1), each n independently represents an integer of about 1 to about 20, such as about 2 or about 3 to about 10 or about 15, or about 5 to about 8. The values x and y represent respective ratios of the respective monomeric units in the polymer, and generally x can range from about 0 to about 1000, such as about 9 to about 70, and y can range from about 0 to about 300, such as about 1 to about 10. In some embodiments, at least one of x and y is greater than 0, and in still other embodiments, both x and y are greater than 0.

For example, one specific material that can be used as the amorphous biodegradable polyester resin in embodiments is the commercially available material BIOREZ™ 64-113 resin, available from Advanced Image Resources, which has the general formula (2):

(2)

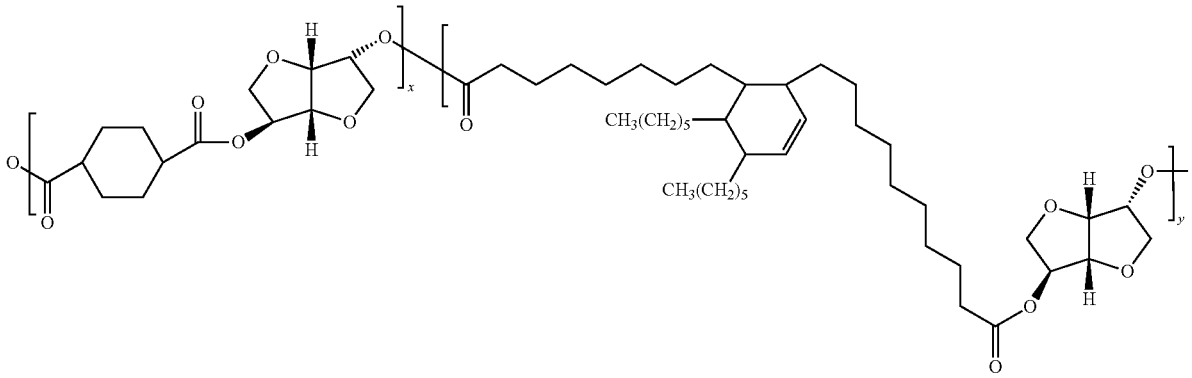

In formula (2), x and y represent respective ratios of the respective monomeric units in the polymer, and generally x can range from about 0 to about 1000, such as about 9 to about 70, and y can range from about 0 to about 300, such as about 1 to about 10. In some embodiments, at least one of x and y is greater than 0, and in still other embodiments, both x and y are greater than 0. This material is a soy-based resin, which contains over 50% of bio-based monomers.

The amorphous biodegradable polyester resins of formula (1) can be suitably made, for example, by reacting a dicarboxylic acid component, an isosorbide component, and a dimer acid component under suitable conditions, such as in the presence of heat and a catalyst, to provide the desired polyester resin. The resins are considered bio-desired because, for example, the isosorbide component and dimer acid components can be obtained from natural sources such as corn and soy beans, while only the dicarboxylic acid component is obtained from petroleum sources. Of course, any of the constituent components can be derived from a variety of courses, whether petroleum-based or not.

For example, the specific material BIOREZ™ 64-113 of formula (2) can be synthesized by reacting the following components (2a)-(2c) in the presence of heat and $Sb_2O_3$:

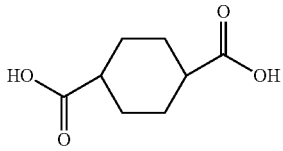

(2a, 1,4-cyclohexane-dicarboxylic acid, derived from petroleum)

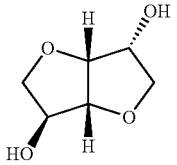

(2b, D-isosorbide, derived from corn)

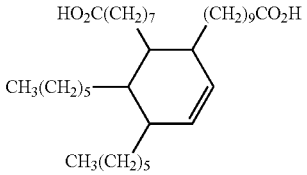

(2c, Dimer acid, derived from soy beans)

In embodiments, the amorphous biodegradable polyester resin may have a Tg of about 40° C. to about 70° C., such as about 50° C. to about 65° C., although the Tg can be outside of these ranges.

The amorphous biodegradable polyester resin can have any suitable and desired molecular weight to provide desired properties to the resultant toner compositions. For example, in some embodiments, the amorphous biodegradable polyester resin can have a weight average molecular weight (Mw) of about 1,000 to about 15,000, such as about 2,000 to about 10,000, and can have a number average molecular weight (Mn) of about 2,000 to about 5,000, such as about 2,500 to about 4,000. The amorphous biodegradable polyester resin can likewise have a suitable molecular weight distribution, MWD (Mw/Mn), such as about 1.5 to about 10 or about 1.75 to about 6. Of course, values outside of these ranges may provide acceptable results in other embodiments.

In embodiments, the emulsion of amorphous biodegradable polyester resin may have an average particle size or diameter of about 50 nm to about 600 nm, such as about 75 nm to about 400 nm, although the particle size can be outside of these ranges.

Other Resin Materials

In addition to the amorphous biodegradable polyester resin described above, the toner compositions may further comprise one or more additional resin materials, to provide desired results. The one or more additional resin materials can be, for example, amorphous, semi-crystalline, or crystalline, and can be derived either from petroleum sources or can be a bio-based resin from renewable sources. The one or more additional resin materials can be an acrylate-based resin, a styrene-based resin, a polyester-based resin, or the like. Numerous suitable such resins are described in the various patent references cited and incorporated by reference above.

In one embodiment, the amorphous biodegradable polyester resin described above may be utilized in combination with a bio-based crystalline resin. The bio-based crystalline resin may be incorporated by co-emulsification with the amorphous biodegradable polymeric resin in the toner composition.

Examples of semi-crystalline resins which may be utilized include polyesters, polyamides, polyimides, polyisobutyrate, and polyolefins such as polyethylene, polybutylene, ethylene-propylene copolymers, ethylene-vinyl acetate copolymers, polypropylene, combinations thereof, and the like. In embodiments, semi-crystalline resins which may be utilized may be polyester based, such as polyhydroxyalkanoates having the formula:

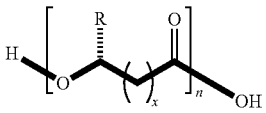

wherein R is independently H or a substituted or unsubstituted alkyl group of from about 1 to about 13 carbon atoms, in embodiments, from about 3 to about 10 carbon atoms, X is from about 1 to about 3, and n is a degree of polymerization of from about 50 to about 20,000, in embodiments, from about 100 to about 15,000.

In embodiments, R can be substituted with groups such as, for example, silyl groups; nitro groups; cyano groups; halide atoms, such as fluoride, chloride, bromide, iodide, and astatide; amine groups, including primary, secondary, and tertiary amines; hydroxy groups; alkoxy groups, such as those having from about 1 to about 20 carbon atoms, in embodiments, from about 2 to about 10 carbon atoms; aryloxy groups, such as those having from about 6 to about 20 carbon atoms, in embodiments, from about 6 to about 10 carbon atoms; alkylthio groups, such as those having from about 1 to about 20 carbon atoms, in embodiments, from about 1 to about 10 carbon atoms; arylthio groups, such as those having from about 6 to about 20 carbon atoms, in embodiments, from about 6 to about 10 carbon atoms; aldehyde groups; ketone groups; ester groups; amide groups; carboxylic acid groups; sulfonic acid groups; combinations thereof and the like.

Suitable polyhydroxyalkanoate resins include polyhydroxybutyrate (PHB), polyhydroxyvalerate (PHV) and copolyesters containing randomly arranged units of 3-hydroxybutyrate (HB) and/or 3-hydroxyvalerate (HV), such as, poly-beta-hydroxybutyrate-co-beta-hydroxyvalerate, and combinations thereof. Other suitable polyhydroxyalkanoate resins are described, for example, in U.S. Pat. No. 5,004,664, the disclosure of which is hereby incorporated by reference in its entirety.

Polyhydroxyalkanoate resins may be obtained from any suitable source, such as, by a synthetic process, as described in U.S. Pat. No. 5,004,664, or by isolating the resin from a microorganism capable of producing the resin. Examples of microorganisms that are able to produce polyhydroxyalkanoate resins include, for example, Alcaligenes eutrophus, *Methylobacterium* sp., *Paracoccus* sp., *Alcaligenes* sp., *Pseudomonas* sp., *Comamonas acidovorans* and *Aeromonas caviae* as described, for example in Robert W. Lenz and Robert H. Marchessault, Macromolecules, Volume 6, Number 1, pages 1-8 (2005), Japanese Patent Application Laid-Open No. 5-74492, Japanese Patent Publication Nos. 6-15604, 7-14352, and 8-19227, Japanese Patent Application Laid-Open No. 9-191893, and Japanese Patent Application Laid-Open Nos. 5-93049 and 7-265065, the entire disclosures each of which are incorporated herein by reference.

In embodiments, the polyhydroxyalkanoates may be obtained from the bacterium Alcaligenes eutrophus. Alcaligenes eutrophus may produce resins in beads with varying particle size of up to about 1 micron. Moreover, as disclosed in Wu, Corrinna, 1997, Sci. News. "Weight Control for bacterial plastics,' p. 23-25, vol. 151:2, the size of the resin can be controlled to less than about 250 nm in diameter.

Commercial polyhydroxyalkanoates resins which may be utilized include BIOPOL™ (commercially available from Imperial Chemical Industries, Ltd (ICI), England), or those sold under the name MIREL™ in solid or emulsion form (commercially available from Metabolix).

Specific non-limiting examples of the bio-based semi-crystalline resins that may be utilized in combination with the amorphous biodegradable polymeric resin include polyhydroxyalkanoates, such as poly(3-hydroxyoctanoate)-co-3-hydroxyhexanoate (PHO).

In embodiments, a ratio of the parts by weight of the amorphous biodegradable polyester resin to the one or more additional resins such as the bio-based semi-crystalline or crystalline resin can be from about 100:0 to about 50:50, such as about 99:1 or about 95:5 to about 70:30 or about 60:40, based on 100 parts by weight of total resin. The ratio can be outside of these ranges.

Surfactants

In embodiments, one, two, or more surfactants may be utilized during the resin emulsification process. The surfactants may be selected from ionic surfactants and nonionic surfactants. Anionic surfactants and cationic surfactants are encompassed by the term "ionic surfactants." In embodiments, the use of anionic and nonionic surfactants help stabilize the aggregation process in the presence of the coagulant, which otherwise could lead to aggregation instability.

In embodiments, the surfactant may be utilized so that it is present in an effective amount, such as an amount of from about 0.01% to about 5% by weight of the resin for example from about 0.75% to about 4% by weight of the resin, in embodiments from about 1% to about 3% by weight of the resin, although the amount of surfactant can be outside of these ranges.

Examples of nonionic surfactants that can be utilized include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ (alkyl phenol ethoxylate). Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™ NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. An example of a suitable cationic surfactant may be SANIZOL B-50 available from Kao Corp., which consists primarily of benzyl dimethyl alkonium chloride.

Buffer Solution

It has been found that the biodegradable polyester resins of this disclosure do not emulsify to an extent that would permit desired emulsion aggregation processes to proceed in a manner that would provide controlled and desired particle size growth. However, it has been found that the addition of a buffer solution allows emulsification to proceed, enabling a subsequent emulsion aggregation process.

In embodiments, a buffer solution is used to ensure pH stability during the emulsification and subsequent temperature ramp to coalescence and to eliminate pH shock to the system, thus avoiding irregularities or toner particles that are out of the desired specifications. The buffer may be selected from any suitable buffer capable of ensuring pH stability during the temperature ramp to coalescence.

In embodiments, the buffer system may include at least two of acids, salts, bases, organic compounds, and combinations thereof in a solution with deionized water as the solvent.

Suitable acids which may be utilized to form the buffer system include, but are not limited to, organic and/or inorganic acids such as acetic acid, citric acid, hydrochloric acid, boric acid, formic acid, oxalic acid, phthalic acid, salicylic acid, combinations thereof, and the like.

Suitable salts or bases which may be utilized to form the buffer system include, but are not limited to, metallic salts of aliphatic acids or aromatic acids and bases, such as sodium hydroxide (NaOH), sodium tetraborate, potassium acetate, zinc acetate, sodium dihydrogen phosphate, disodium hydrogen phosphate, potassium formate, potassium hydroxide, sodium oxalate, sodium phthalate, potassium salicylate, combinations thereof, and the like.

Suitable organic compounds which may be utilized to form the buffer system include, but are not limited to, tris(hydroxymethyl)aminomethane ("TRIS"), Tricine, Bicine, Glycine, HEPES, Trietholamine hydrochloride, MOPS, combinations thereof, and the like.

In embodiments, a suitable buffer system may include a combination of acids and organic compounds. For example, a buffer system may include TRIS and hydrochloric acid.

The amount of acid and organic compound utilized in forming the buffer system, as well as deionized water utilized in forming a buffer solution, may vary depending upon the acid used, the organic compound used, and the composition of the toner particles. As noted above, a buffer system may include both an acid and an organic compound. In such a case, the amount of acid in the buffer system may be from about 1% to about 40% by weight of the buffer system, such as from about 2% to about 30% by weight. The amount of organic compound in the buffer system may be from about 10% to about 50% by weight of the buffer system, such as from about 30% to about 40% by weight of the buffer system.

The amount of acid and/or organic compound in the buffer system may be in amounts so that the pH of the buffer system is from about 7 to about 12, such as from about 7 to about 9, from about 8 to about 9, or about 9.

The buffer system may be added to the resin emulsion (resin, surfactant, and water) described above so that the pH of the final toner slurry is from about 6 to about 9, such as from about 7 to about 8.

Solvent

To form the emulsion, the bio resin and an initiator are dissolved in a suitable organic solvent under conditions that allow the solution to be formed. Suitable solvents that can be used include those in which the resin and any other optional components (such as a wax) is soluble, and that dissolves the resin component to form an emulsion, but which solvents can be subsequently flashed off to leave the resin in an emulsion, such as in water, at the desired particle size. For example, suitable solvents include alcohols, ketones, esters, ethers, chlorinated solvents, nitrogen containing solvents and mixtures thereof. Specific examples of suitable solvents include dichloromethane, acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. Particular solvents that can be used include dichloromethane, acetone, methyl ethyl ketone, cyclohexanone, methyl acetate, ethyl acetate, dimethylsulfoxide, and mixtures thereof. If desired or necessary, the resin can be dissolved in the solvent at elevated temperature, such as about 40 to about 80° C. or about 50 to about 70° C. or about 60 to about 65° C., although the temperature is desirably lower than the glass transition temperature of the resin. In embodiments, the resin is dissolved in the solvent at elevated temperature, but below the boiling point of the solvent, such as at about 2 to about 15° C. or about 5 to about 10° C. below the boiling point of the solvent.

Neutralization Agent

If desired or necessary, an optional amount of a neutralization agent can be added to the buffer solution, where the amount of neutralizer generally depends upon the acid number of the resin. Examples of suitable neutralization agents include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable neutralization agent is sodium bicarbonate or ammonium hydroxide.

When the neutralization agent is used in the composition, it is typically present at a level of from about 0.1 to about 5 percent, such as about 0.5 to about 3 percent by weight of the resin. When such salts are added to the composition as a neutralization agent, it is desired in embodiments that incompatible metal salts are not present in the composition. For example, when these salts are used, the composition should be completely or essentially free of zinc and other incompatible metal ions, e.g., Ca, Fe, Ba, etc., which form water-insoluble salts. The term "essentially free" refers, for example, to the incompatible metal ions as present at a level of less than about 0.01 percent, such as less than about 0.005 or less than about 0.001 percent by weight of the wax and resin. If desired or necessary, the neutralization agent can be added to the mixture at ambient temperature, or it can be heated to the mixture temperature prior to addition.

Emulsification Process

The emulsion of the resin can be made by any of various methods. One such method, which can be suitably altered by those skilled in the art, generally include the following steps:

(1) Measure resin into a suitable container;
(2) Add solvent to resin;
(3) Dissolve resin in solvent, optionally by heating (for example below the solvent boiling point) and with stirring;
(4) Add a buffer solution to a reactor vessel;
(5) Optionally add a desired amount of neutralization agent to the buffer solution, where the amount of neutralization agent generally depends upon the acid number of the resin;
(6) Optionally add a surfactant to the buffer solution;
(7) Add deionized water to the buffer solution;
(8) Optionally heat the buffer/water solution to an elevated temperature, but below the boiling point of the solvent;
(9) Begin homogenizing the buffer/water solution;
(10) Slowly pour the resin solution into the buffer/water solution as the mixture continues to be homogenized, and optionally increase homogenizer speed;
(11) Homogenize the mixture;
(12) Place the homogenized mixture into a suitable vessel for solvent flashing, such as a heat jacketed distillation apparatus;
(13) Commence stirring and heat the homogenized mixture to above about the boiling point of the solvent;
(14) Distill or solvent flash the solvent from the homogenized mixture, and then cool the mixture;
(15) Optionally discharge the product from the solvent flash apparatus, screen the product as necessary; and
(16) pH adjust the product to 7.0 as necessary.

Toner Aggregation

In embodiments, toner compositions may be prepared using the emulsion, such as by an emulsion aggregation process. Once the emulsion of biodegradable polyester resins and buffer is provided, aggregation may be conducted by mixing the resin emulsion with a colorant and a coagulant, and also by optionally adding a wax, a surfactant, or other materials, which may also be optionally in a dispersion(s).

When a colorant is used, the colorant may be a pigment, a dye, a combination of pigments, a combination of dyes, or a combination of pigments and dyes. The colorant may be included in the toner in an amount of, for example, about 0.1 to about 35 percent by weight of the toner, or from about 1 to about 15 weight percent of the toner, or from about 3 to about 10 percent by weight of the toner, although the amount of colorant can be outside of these ranges.

As examples of suitable colorants, mention may be made of carbon black like REGAL 330® (Cabot), Carbon Black 5250 and 5750 (Columbian Chemicals), Sunsperse Carbon Black LID 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta E02 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include carbon black, magnetite, black, cyan, magenta, yellow, red, green, blue, brown, or combinations thereof, in an amount sufficient to impart the desired color to the toner. It is to be understood that other useful colorants will become readily apparent based on the present disclosures.

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles, although the amount of wax can be outside of these ranges.

When a wax dispersion is used, the wax dispersion may include any of the various waxes conventionally used in emulsion aggregation toner compositions. Waxes that may be selected include waxes having, for example, a weight average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

The pH of the resulting mixture may be adjusted by an acid such as, for example, acetic acid, sulfuric acid, hydrochloric acid, citric acid, trifluro acetic acid, succinic acid, salicylic acid, nitric acid or the like. In embodiments, the pH of the mixture may be adjusted to from about 2 to about 5. In embodiments, the pH is adjusted utilizing an acid in a diluted form in the range of from about 0.5 to about 10 weight percent by weight of water, in other embodiments, in the range of from about 0.7 to about 5 weight percent by weight of water.

Examples of bases used to increase the pH and ionize the aggregate particles, thereby providing stability and preventing the aggregates from growing in size, can include sodium hydroxide, potassium hydroxide, ammonium hydroxide, cesium hydroxide and the like, among others.

Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture, although the amount of aggregating agent can be outside of these ranges.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a biodegradable polyester resin as described above may be included in the shell. In yet other embodiments, the biodegradable polyester resin described above may be combined with another resin and then added to the particles as a resin coating to form a shell. Of course, any resins conventionally used for toner formation may be used in forming a shell.

The shell resin may be applied to the aggregated particles by any method within the purview of those skilled in the art. In embodiments, the resins utilized to form the shell may be in an emulsion including any surfactant described above. The emulsion possessing the resins, may be combined with the aggregated particles described above so that the shell forms over the aggregated particles. In embodiments, the shell may have a thickness of up to about 5 microns, in embodiments, of from about 0.1 to about 2 microns, in other embodiments, from about 0.3 to about 0.8 microns, over the formed aggregates.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

For example, in some embodiments, the toner process may include forming a toner particle by mixing the polymer latexes, in the presence of a wax and a colorant dispersion, with an optional coagulant while blending at high speeds. The resulting mixture having a pH of, for example, of from about 2 to about 3, is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution, until a pH of about 7 is achieved.

Toner Coalescence

Following aggregation to the desired particle size and application of any optional shell, the particles may then be coalesced to the desired final shape, the coalescence being achieved by, for example, heating the mixture to a temperature of from 45° C. to 100° C., in embodiments from 55° C. to 99° C., which may be at or above the glass transition temperature of the resins utilized to form the toner particles, and/or reducing the stirring, for example to from 100 rpm to 1,000 rpm, in embodiments from 200 rpm to 800 rpm. The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from 0.01 to 9 hours, in embodiments from 0.1 to 4 hours.

After aggregation and/or coalescence, the mixture may be cooled to room temperature, such as from 20° C. to 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner, although the amount of additives can be outside of these ranges. In embodiments, the toners may include, for example, from about 0.1 weight percent to about 5 weight percent titania, from about 0.1 weight percent to about 8 weight percent silica, and from about 0.1 weight percent to about 4 weight percent zinc stearate.

Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics.

(1) Number Average Geometric Size Distribution (GSDn) and/or Volume Average Geometric Size Distribution (GSDv): In embodiments, the toner particles may have a very narrow particle size distribution with a lower number ratio GSD of from about 1.15 to about 1.38, in other embodiments, less than about 1.31. The toner particles of the present disclosure may also have a size such that the upper GSD by volume in the range of from about 1.20 to about 3.20, in other embodiments, from about 1.26 to about 3.11. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(2) Shape factor of from about 105 to about 170, in embodiments, from about 110 to about 160, SF1*a. Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

(3) Circularity of from about 0.92 to about 0.99, in other embodiments, from about 0.94 to about 0.975. The instrument used to measure particle circularity may be an FPIA-2100 manufactured by Sysmex.

(4) Volume average diameter (also referred to as "volume average particle diameter") was measured for the toner particle volume and diameter differentials. The toner particles have a volume average diameter of from about 3 to about 25 μm, in embodiments from about 4 to about 15 μm, in other embodiments from about 5 to about 12 μm.

The characteristics of the toner particles may be determined by any suitable technique and apparatus and are not limited to the instruments and techniques indicated hereinabove.

In embodiments, the toner particles may have a weight average molecular weight (Mw) in the range of from about 17,000 to about 60,000 daltons, a number average molecular weight (Mn) of from about 9,000 to about 18,000 daltons, and a MWD (a ratio of the Mw to Mn of the toner particles, a measure of the polydispersity, or width, of the polymer) of from about 2.1 to about 10. For cyan and yellow toners, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10. For black and magenta, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10.

Further, the toners if desired can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder which represents the highest peak of the Mw. In the present disclosure, the binder can have a molecular peak (Mp) in the range of from about 22,000 to about 30,000 daltons, in embodiments, from about 22,500 to about 29,000 daltons. The toner particles prepared from the binder also exhibit a high molecular peak, for example, in embodiments, of from about 23,000 to about 32,000, in other embodiments, from about 23,500 to about 31,500 daltons, indicating that the molecular peak is driven by the properties of the binder rather than another component such as the colorant.

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH. Toners of the present disclosure may possess a parent toner charge per mass ratio (Q/M) of from about −2 μC/g to about −28 μC/g, in embodiments from about −4 μC/g to about −25 μC/g, and a final toner charging after surface additive blending of from −8 μC/g to about -25 μC/g, in embodiments from about −10 μC/g to about −22 μC/g.

Developer

The toner particles may be formulated into a developer composition. For example, the toner particles may be mixed with carrier particles to achieve a two-component developer composition. The carrier particles can be mixed with the toner particles in various suitable combinations. The toner concentration in the developer may be from 1% to 25% by weight of the developer, in embodiments from 2% to 15% by weight of the total weight of the developer. In embodiments, the toner concentration may be from 90% to 98% by weight of the carrier. However, different toner and carrier percentages may be used to achieve a developer composition with desired characteristics.

Carriers

Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 weight % to about 70 weight %, in embodiments from about 40 weight % to about 60 weight %. The coating may have a coating weight of, for example, from about 0.1 weight % to about 5% by weight of the carrier, in embodiments from about 0.5 weight % to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

Toners of the present disclosure may be utilized in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20 ° C. to about 25° C.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Preparation of Emulsion

Example 1

100 g of BIOREZ™ 64-113 resin, available from Advanced Imaging Resources, was measured into a 2 liter beaker containing about 1000 g of ethyl acetate. The mixture was stirred at about 300 revolutions per minute at room temperature to dissolve the resin in the ethyl acetate. 186 g of sodium bicarbonate, 10.64 g of Dowfax (47 wt %), and 50 g of Tris-HCl pH 8 buffer was measured into a 3 liter Pyrex glass flask reactor containing about 700 g of deionized water. Homogenization of the water solution in the 3 liter glass flask reactor occurred with an IKA Ultra Turrax T50 homogenizer at 4,000 revolutions per minute. The resin solution was then slowly poured into the water solution as the mixture continued to be homogenized, with the homogenizer speed increased to 8,000 revolutions per minute. Homogenization was carried out at these conditions for about 30 minutes. Upon completion of homogenization, the glass flask reactor and its contents were placed in a hot plate and purged with air. The mixture was stirred at about 250 revolutions per minute and the temperature of the mixture was increased to 50-55° C. to evaporate off the ethyl acetate from the mixture. Stirring of the mixture continued at 50-55° C. for about 180 minutes followed by cooling to room temperature.

The product was centrifuged and the bottom sediment was discarded. The resulting resin emulsion was weighed and solid content was measured. Emulsion yield was calculated by solid content multiplies weight of emulsion.

Preparation of Emulsion

Examples 2-4 and Comparative Examples 1-2

In Example 2, the same emulsification procedure as Example 1 was applied except that 20 g of pH 8 Tris-HCl buffer was used for the buffer system. In Example 3, the same emulsification procedure as Example 1 was applied except that 10 g of pH 8 Tris-HCl buffer was used. In Example 4, the procedure of Example 2 was repeated. In Comparative Example 1, the same emulsification procedure as Example 1 was applied except that no buffer was used. In Comparative Example 2, the same emulsification procedure as Example 1 was applied except that pH 7 Tris-HCl buffer was used. The emulsification results are shown in Table 1.

TABLE 1

| | Buffer system | Particle size | pH | Yield (%) |
|---|---|---|---|---|
| Example 1 | pH 8 buffer, 50 g | 169.3 nm | 8.42 | 83.8 |
| Example 2 | pH 8 buffer, 20 g | 169.3 nm | 8.26 | 100 |
| Example 3 | pH 8 buffer, 10 g | 141.8 nm | 7.81 | 80.09 |
| Example 4 (repeat of Example 2) | pH 8 buffer, 20 g | 146.9 nm | 8.33 | 95.59 |
| Comparative Example 1 | No buffer | All resins settled out | 6.1 | 0 |
| Comparative Example 2 | pH 7 buffer | All resins settled out | 6.5 | 0 |

As shown in Table 1, in Examples 1-4, BIOREZ™ 64-113 was emulsified. Specially, in Examples 2 and 4, a yield was higher than 90%. From these results, the optimized formulation was using 20g of buffer for every 100 g of BIOREZ™ 64-113 resin.

Preparation of Toner

Example 5

Into a 600 ml glass beaker equipped with an magnetic stir bar and a hotplate, 242.80 g of the emulsion obtained in Example 2 (100 g of BIOREZ™ 64-113, 20 g of buffer, 18.39 wt %), 15.56 g of cyan pigment dispersion PB15:3 (17.0 wt %), and 44.80 g of $Al_2(SO_4)_3$ solution (1 wt %) was added as flocculent under homogenization.

The mixture was subsequently heated to 45 ° C. for aggregation at 700 rpm. The particle size was monitored with a Coulter Counter until the core particles reached a volume average particle size of 5.37 microns with a GSD of 1.30.

Then, the pH of the reaction slurry was increased to 7.81 using 3.46 g EDTA (39 wt %) and NaOH (4 wt %) to freeze the toner growth. After freezing, the reaction mixture was heated to 90° C., and pH was reduced to 7.66 for coalescence. The toner was quenched after coalescence, and it has a final particle size of 10.37 microns, a GSD volume of 1.29, and a GSD number of 1.61. The toner slurry was then cooled to room temperature, separated by sieving (25 microns), filtration, followed by washing and freeze dried.

Preparation of Emulsion

Example 6

A bio-based crystalline resin was incorporated by co-emulsification with BIOREZ™ 64-113 resin. 88.39 g of BIOREZ™ 64-113 resin and 12.64g of bio-based crystalline resin poly(3-hydroxyoctanoate-co-3-hydroxyhexanoate (PHO) obtained from Queen's University were measured into a 2 liter beaker containing about 1000 g of ethyl acetate. Ratio of the weight % of the Tris-HCl pH 8 buffer to the BIOREZ™ 64-113 resin and PHO resin was 20:100. The mixture was stirred at about 300 revolutions per minute at room temperature to dissolve the resin in the ethyl acetate. 1.64 g of sodium bicarbonate, 9.40 g Dowfax (47 wt %), and 20.2 g of Tris-HCl pH 8 buffer was measured into a 3 liter Pyrex glass flask reactor containing about 700 g of deionized water. Homogenization of said water solution in said 3 liter glass flask reactor occurred with an IKA Ultra Turrax T50 homogenizer at 4,000 revolutions per minute. The resin solution was then slowly poured into the water solution as the mixture continued to be homogenized, the homogenizer speed was increased to 8,000 revolutions per minute and homogenization was carried out at these conditions for about 30 minutes. Upon completion of homogenization, the glass flask reactor and its contents were placed on a hot plate and purged with air. The mixture was stirred at about 250 revolutions per minute and the temperature of said mixture was heated to 50-55° C. to evaporate off the ethyl acetate from the mixture. Stirring of the said mixture was continued at 50-55 ° C. for about 180 minutes followed by cooling to room temperature.

The product was centrifuged and the bottom sediment was discarded. The resulting emulsion was 165 nm in size and comprised of about 23.04 wt % solids in water.

Preparation of Toner

Example 7

Into a 600 ml glass beaker equipped with an magnetic stir bar and a hotplate, 185.18 g of the emulsion obtained in Example 6 (88.39 g of BIOREZ™ 64-113, 12.64 g of PHO, 20.2 g of buffer, 23.04 wt %), 14.886 g of cyan pigment dispersion PB15:3 (17.0 wt %), and 42.81 g of $Al_2(SO_4)_3$ solution (1 wt %) was added as flocculent under homogenization.

The mixture was subsequently heated to 49 ° C. for aggregation at 700 rpm. The particle size was monitored with a Coulter Counter until the core particles reached a volume average particle size of 5.71 nm with a GSD of 1.31, and then the pH of the reaction slurry was then increased to 8.10 using 1.65 g EDTA (39 wt %) and NaOH (4 wt %) to freeze the toner growth. After freezing, the reaction mixture was heated to 90° C., and pH was reduced to 7.44 for coalescence. The toner was quenched after coalescence, and it has a final particle size of 6.15 microns, GSD volume of 1.33, and GSD number of 1.48. The toner slurry was then cooled to room temperature, separated by sieving (25 microns), filtration, followed by washing and freeze dried.

Charging Evaluation

Fusing characteristics of the toners produced in Examples 5 and 7 and a reference toner were determined. Developer samples were prepared in a 60 milliliter glass bottle by weighing about 0.5 g of toner onto about 10 g of FWC 938 as a carrier which included a steel core and a coating of a polymer mixture of polymethylmethacrylate (PMMA, 60 wt %) and polyvinylidene fluoride (40 wt %). The samples were kept in the respective environments overnight, about 24 hours to fully equilibrate. The following day, the developer samples were mixed for about 1 hour using a Turbula mixer, after which the charge on the toner particles was measured using a charge spectrograph. The toner charge was calculated as the midpoint of the toner charge distribution. The charge was in millimeters of displacement from the zero line for both the parent particles and particles with additives. The RH ratio (relative humidity ratio) was calculated as the A-zone charge at 85 wt % humidity (in millimeters) over the C-zone charge at 15 wt % humidity (in millimeters). The charging results were shown in Table 2.

TABLE 2

| | Reference | Example 5 | Example 7 |
|---|---|---|---|
| Carrier | | FWC938 | FWC938 |
| Q/d A-zone 60M | 8.8 | 0.8 | 1.3 |
| Q/m A-zone 60M | 40 | 23 | 11 |
| Q/m A-zone 2M | 58 | 24 | 16.6 |
| Q/d C-zone 60M | 14.6 | 4.0 | 8.2 |
| Q/m C-zone 60M | 66 | 75 | 56 |
| Charge maintenance 24 hours | 72 | 94 | 66 |
| Blocking at 54° C. (%) | 66 | 38.9 | 92 |

As shown in Table 2, the toner of Examples 5 and 7 had comparative charging as the reference toner.

Preparation of Toner

Example 8

The same procedure as Example 5 was repeated. The average particle size was 6.15 microns, a GSD volume was 1.33, and a GSD number was 1.56.

Preparation of Toner

Example 9

The same procedure as Example 7 was repeated. The average particle size was 6.15 microns, a GSD volume was 1.34, and a GSD number was 1.46.

Fusing Evaluation/Gloss

Unfused test images were made using a Xerox Corporation DC12 color copier/printer. Images were removed from the Xerox Corporation DC12 before the document passed through the fuser. Initial fusing evaluation was carried out by using a Xerox Corporation iGen3® (XP777) fuser. Standard operating procedures were followed where unfused images of a control toner (iGen3® Cyan Series 9) was developed onto Xerox Corporation DCX+ 90 gsm and DCEG 120 gsm paper. The toner mass per unit area for the unfused images was 0.5 mg/cm$^2$. The control toners as well as the test toners were fused over a wide range of temperatures. Fuser roll temperature was varied during the experiments so that gloss and crease area could be determined as a function of the fuser roll temperature. Print gloss was measured using a BYK Gardner 75° gloss meter. Cold offset, gloss, crease fix, and document offset performance were measured.

The results of Examples 8 and 9 indicated that both of the toner containing BIOREZ™ 64-113 only and the toner containing BIOREZ™ 64-113 and PHO have similar gloss to i-Gen-3 control toner.

Fusing Evaluation/MFT

How well toner adheres to the paper was determined by its crease fix minimum fusing temperature (MFT). The fused image was folded and about 860 g weight of toner was rolled across the fold after which the page was unfolded and wiped to remove the fractured toner from the sheet. This sheet was then scanned using an Epson flatbed scanner and the area of toner which had been removed from the paper was determined by image analysis software such as the National Instruments IMAQ. The results of fusing evaluation is shown in FIG. 2.

The results showed that at the point where the Crease Area is 85, the MFT of Example 6 was 179° C., the MFT of Example 8 was 160° C., while the MFT of iGen3® control toner was 169° C. The MFT results show that the toner of Example 9 has 10° C. higher MFT than iGen3® control, but by adding 12 wt % of PHO, 19° C. lower MFT was obtained, which gives a lower MFT than iGen3® control.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for preparing a toner, comprising:

forming an emulsion comprising a buffer solution and an amorphous biodegradable polyester resin represented by Formula (1):

(1)

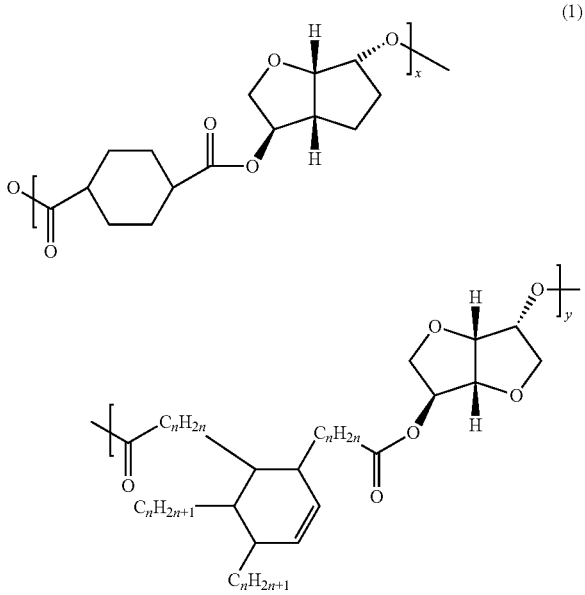

wherein each n independently represents an integer of 1 to about 20, x and y represent respective ratios of respective monomeric units, x ranges from about 0 to about 1000, y ranges from about 0 to about 300,and at least one of x or y is greater than 0;

adding a colorant, a coagulant, and optionally a wax to the emulsion to form a mixture;

heating the mixture, permitting aggregation and coalescence of the mixture to form toner particles; and recovering the toner particles, wherein the buffer solution comprises an organic compound and an acid.

2. The process of claim 1, wherein the emulsion is formed by:

dissolving the amorphous biodegradable polyester resin in an organic solvent to form an organic solution, preparing an aqueous solution comprising the buffer solution, an optional neutralization agent, and an optional surfactant;

combining the organic solution and the aqueous solution to form a mixture, and homogenizing the mixture; and removing the organic solvent by heating the mixture to above about a boiling point of the solvent but below a boiling point of water.

3. The process of claim 2, wherein the solvent is selected from the group consisting of alcohols, ketones, esters, ethers, chlorinated solvents, nitrogen containing solvents, and mixtures thereof.

4. The process of claim 2, wherein the solvent is selected from the group consisting of acetone, methyl ethyl ketone, tetrahydrofuran, cyclohexanone, ethyl acetate, N,N dimethylformamide, dioctyl phthalate, toluene, xylene, benzene, dimethylsulfoxide, dichloromethane, and mixtures thereof.

5. The process of claim 1, wherein x ranges from about 9 to about 70 and y ranges from about 1 to about 10.

6. The process of claim 1, wherein x and y are each greater than 0.

7. The process of claim 1, wherein the amorphous biodegradable polyester resin is represented by Formula (2):

(2)

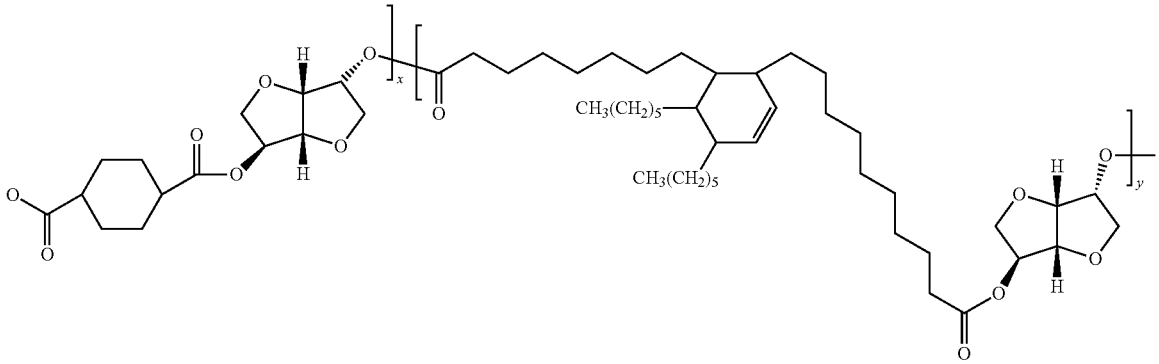

wherein x and y represent respective ratios of respective monomeric units, x ranges from about 0 to about 1000, y ranges from about 0 to about 300, and at least one of x or y is greater than 0.

8. The process of claim 7, wherein x and y are each greater than 0.

9. The process of claim 1, wherein the amorphous biodegradable polyester resin has a Tg between 40° C. and 70° C.

10. The process of claim 1, wherein the amorphous biodegradable polyester resin has a weight average molecular weight of about 1,000 to about 15,000, a number average molecular weight of about 2,000 to about 5,000, and a molecular weight distribution of about 1.5 to about 10.0.

11. The process of claim 1, wherein the amorphous biodegradable polyester resin has an average particle size of from about 50 nm to about 600 nm in diameter.

12. The process of claim 1, further comprising adding a semi-crystalline biodegradable resin in the mixture.

13. The process of claim 12, wherein the semi-crystalline biodegradable resin comprises a polyhydroxyalkanoate of the formula:

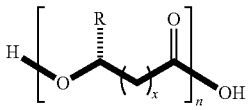

wherein R is H, a substituted alkyl group, or an unsubstituted alkyl group having from about 1 to about 13 carbon atoms, X is from about 1 to about 3, and n is from about 50 to about 10,000.

14. The process of claim 13, wherein the polyhydroxyalkanoate is selected from the group consisting of polyhydroxybutyrate, polyhydroxyvalerate, copolyesters containing randomly arranged units of 3-hydroxybutyrate and 3-hydroxyvalerate, and combinations thereof.

15. The process of claim 13, wherein the bio-based crystalline resin is poly(3-hydroxyoctanoate)-co-3-hydroxyhexanoate.

16. The process of claim 12, wherein said semi-crystalline biodegradable resin is produced by a bacterium which includes Alcaligenes eutrophus.

17. The process of claim 1, wherein the buffer solution has a pH of about 8.

18. The process of claim 1, wherein:

the organic compound comprises one or more compounds selected from the group consisting of tris(hydroxymethyl)aminomethane ("TRIS"), Tricine, Bicine, Glycine, HEPES, Trietholamine hydrochloride, and MOPS, and the acid comprises one or more acids selected from the group consisting of an aliphatic acid, an aromatic acid, acetic acid, citric acid, hydrochloric acid, boric acid, formic acid, oxalic acid, phthalic acid, and salicylic acid.

19. The process of claim 1, wherein the organic compound and the acid together form a buffer solution that comprises TRIS-HCl.

* * * * *